US005213090A

United States Patent [19]

Tone

[11] Patent Number: 5,213,090

[45] Date of Patent: May 25, 1993

[54] PIVOTAL ARROW REST FOR REDUCING INACCURACY CAUSED BY SPIRAL ARROW FLETCHING STRIKING RESILIENT ARROW REST ARMS

[75] Inventor: Richard D. Tone, Gilbert, Ariz.

[73] Assignee: Cavalier Equipment Company, Inc., Gilbert, Ariz.

[21] Appl. No.: 795,204

[22] Filed: Nov. 18, 1991

[51] Int. Cl.[5] ..... F41B 5/22

[52] U.S. Cl. ..... 124/44.5; 124/24.1

[58] Field of Search ..... 124/24.1, 44.5

[56] References Cited

U.S. PATENT DOCUMENTS

| | | | |
|---|---|---|---|
| 3,372,686 | 3/1968 | Losh | 124/24.1 |
| 3,504,659 | 4/1970 | Babington | 124/24.1 |
| 3,865,096 | 2/1975 | Troncoso, Jr. | 124/24.1 |
| 3,935,854 | 2/1976 | Troncoso, Jr. | 124/24.1 |
| 4,332,232 | 6/1982 | Troncoso, Jr. | 124/24.1 |
| 4,344,409 | 8/1982 | Barner | 124/24.1 |
| 4,398,528 | 8/1983 | Troncoso, Jr. | 124/24.1 |
| 4,489,704 | 12/1984 | Troncoso, Jr. | 124/24.1 |
| 4,579,101 | 4/1986 | Bateman, III . | |
| 4,686,956 | 8/1987 | Troncoso | 124/44.5 |
| 4,748,964 | 6/1988 | Troncoso | 124/44.5 |
| 4,803,971 | 2/1989 | Fletcher . | |
| 4,809,670 | 3/1989 | Simo . | |
| 4,827,895 | 5/1989 | Troncoso | 124/44.5 |
| 4,838,237 | 6/1989 | Cliburn . | |
| 5,103,797 | 4/1992 | Newbold | 124/44.5 |
| 5,117,803 | 6/1992 | Johnson | 124/44.5 |

*Primary Examiner*—Randolph A. Reese
*Assistant Examiner*—John Ricci
*Attorney, Agent, or Firm*—Cahill, Sutton & Thomas

[57] ABSTRACT

An arrow rest mechanism for attachment to a bow includes a bracket rigidly attached to the bow and an arrow rest assembly having at least one resilient arm supporting a shaft of a released arrow and absorbing vertical force due to spine or vertical plane flexing the arrow as it is released. A hinge pivotally connects the resilient arm to the bracket, a pivot axis of the arm being located slightly ahead of the point at which the resilient arm supports the arrow. The arm pivots forward in reaction to being struck by spiral fletching of the released arrow, thereby imparting minimal upward counter-force to the tail end of the released arrow. Erratic flight of the arrow due to spine of the released arrow is nearly eliminated.

13 Claims, 4 Drawing Sheets

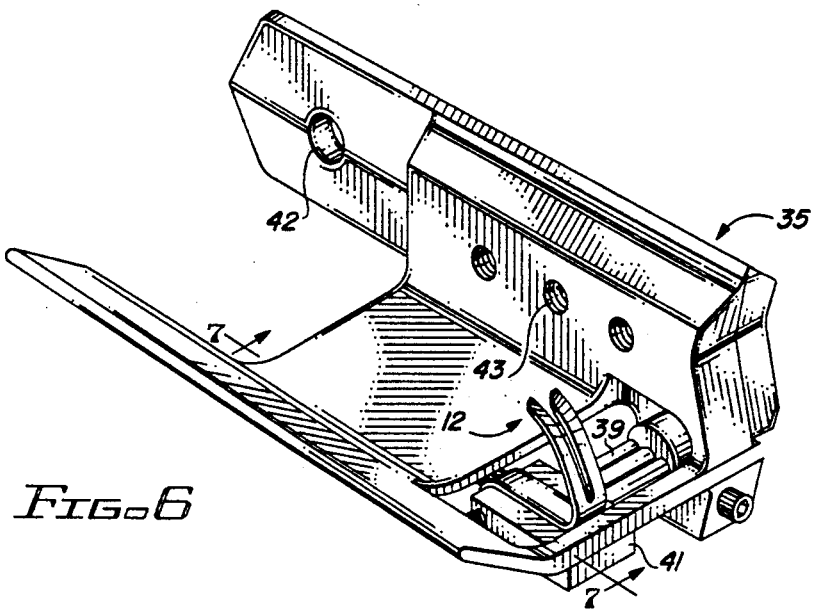
FIG. 6
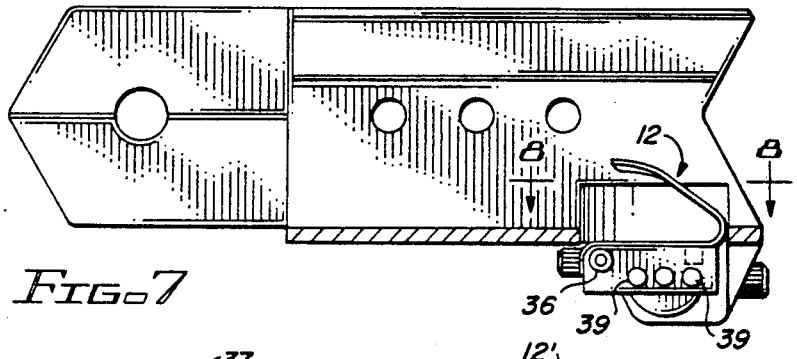
FIG. 7
FIG. 10
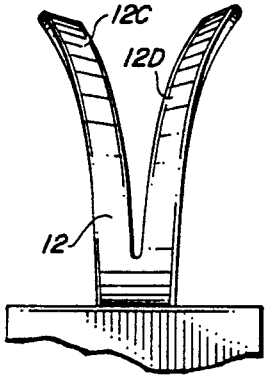
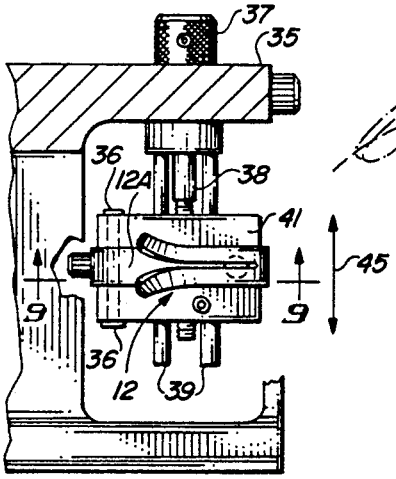
FIG. 8
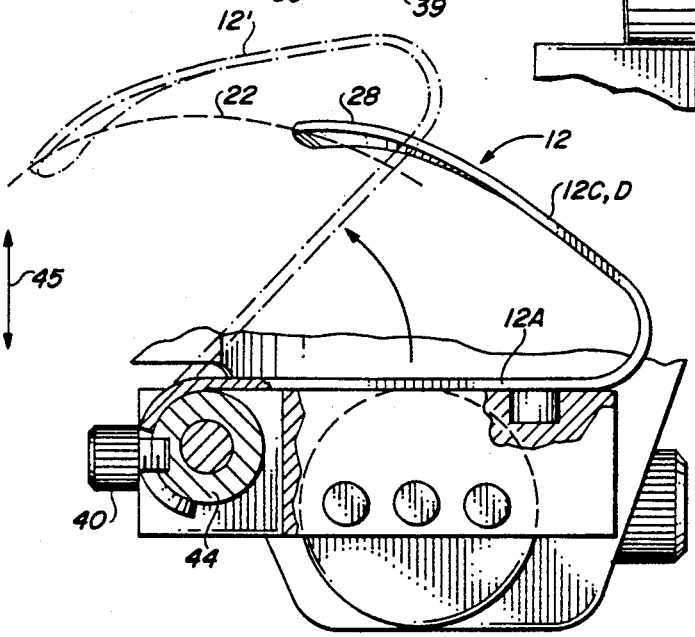
FIG. 9

PIVOTAL ARROW REST FOR REDUCING INACCURACY CAUSED BY SPIRAL ARROW FLETCHING STRIKING RESILIENT ARROW REST ARMS

BACKGROUND OF THE INVENTION

The invention relates to arrow rests, especially those with resilient arms that support an arrow as it is released and accommodate vertical plane flexing of the arrow, and more particularly to improvements in such arrow rests to reduce erratic flight of the arrow when fletching of the released arrow strikes the resilient arms.

It is well known that a released arrow undergoes a series of flexing and bowing motions during flight. Such flexing affects the accuracy and range of the arrow. In recent years, so-called "paradox" resulting from manual release of an archer's fingers, and also from deficiencies of early mechanical arrow release devices, have been largely overcome by improved mechanical release devices. However, if a fletching vane of an arrow strikes a rigid or resilient arm of arrow rest during flight, the arrow is knocked out of its desired trajectory and is slowed down. This sharply reduces the accuracy and distance of the shot. Use of most mechanical release devices results in substantial rapid vertical oscillation of the arrow. Such vertical oscillation is very erratic in nature and results in a great reduction in distance and shooting accuracy.

The great majority of all archery equipment sold is used for hunting. Hunting arrows usually have large broadhead arrow tips, and require large spiral or helical or offset fletching vanes to cause spinning of the arrow during flight. (Such spinning is necessary for broadhead hunting arrows to reduce inaccuracy due to windplaning.) Arrow rests have been designed with notches through which straight (non-spiral) fletching vanes of a released arrow can pass without striking the arrow rest have been designed. For example, see FIGS. 6 and 7 of U.S. Pat. No. 3,935,854 by Troncoso, Jr. However, some of the large spiral fletching vanes required for broadhead hunting arrows invariably strike the arrow supporting arms of all prior arrow rests of which I am aware. This has been proven by means of very recent high speed motion picture films. As an example of the inaccuracy this can cause, a broadhead arrow with large spiral fletching vanes, shot by a good archer to a target sixty yards away and striking a prior art arrow rest, usually will result in arrows being spread within a thirty inch diameter grouping on the target. However, if target arrows with small, straight fletching vanes which do not strike the arrow rest are used, the same archer can maintain a grouping within a six inch diameter area of the target, using a mechanical release and resilient arrow rest arms to avoid errors due to vertical spining.

The prior art has not disclosed a way of avoiding striking of an arrow rest by large spiral fletching vanes. There is an unmet need for an arrow rest device which improves the erratic flight of arrows due to striking of spiral fletching vanes against an arrow rest.

SUMMARY OF THE INVENTION

Accordingly, it is an object of the invention to provide an arrow rest that avoids erratic flight of arrows, especially arrows with spiral fletching vanes that strike the arrow rest upon release of the arrow.

Briefly described, and in accordance with one embodiment thereof, the invention provides an arrow rest mechanism for attachment to a bow, including a bracket rigidly attached to the bow, and an arrow rest assembly including at least one pivotal arm having an arrow shaft contact point supporting a shaft of a released arrow and absorbing vertical forces due to vertical plane flexing of the released arrow. A hinge pivotally connects the arm in fixed relation to the bracket. A pivot axis of the arm is located a small distance ahead of the contact point, so that the arm pivots forward in reaction to being struck by fletching of the released arrow, imparting minimal upward displacement of the contact point and the arrow. Erratic flight of the arrow caused by counter-forces imparted to the tail end of the arrow by the spiral fletching striking the arrow rest is greatly reduced. In the described embodiments, the predetermined distance is as little as one-sixteenth of an inch. In one embodiment, the arrow rest assembly includes first and second resilient arms each having a contact point for supporting the shaft of the released arrow and absorbing the vertical forces due to spine of the released arrow. The first and second arms are bifurcated from a single pivotal support arm in one embodiment, and are independently pivoted in another. In another embodiment, the arrow rest mechanism includes a resilient button assembly engaging a side of the released arrow. The resilient button yields to horizontal plane flexing of the released arrow, reducing inaccuracy due to counter-forces on the tail end of the arrow which otherwise would be caused by such horizontal plane flexing.

BRIEF DESCRIPTION OF THE DRAWINGS

FIG. 6 is a perspective view of another embodiment of the invention.

FIG. 7 is a section view taken along section line 7—7 of FIG. 6.

FIG. 8 is a section view taken along section line 8—8 of FIG. 7.

FIG. 9 is a partial cutaway section view illustrating pivoting of the arrow rest in the embodiment of FIG. 6.

FIG. 10 is a partial rear view illustration of the arrow rest support arms of the embodiment of FIG. 6.

DETAILED DESCRIPTION OF THE PREFERRED EMBODIMENT

Figure 1:
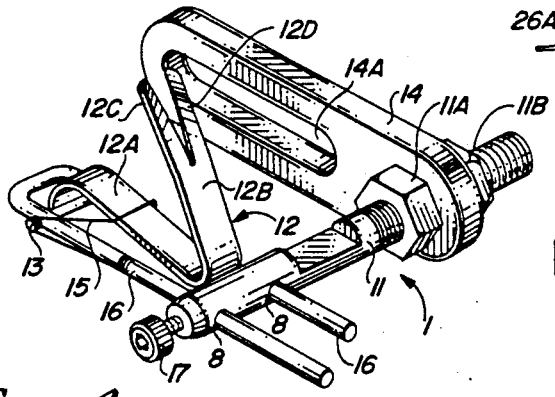
FIG. 1 is a perspective view illustrating one embodiment of the present invention.

FIG. 1 shows an arrow rest assembly 1 of the present invention. Assembly 1 includes a bar 14 that is bolted through elongated slot 14A onto the right hand side of a bow 10 shown in FIGS. 2 and 5. A bolt 11 is connected to the rear end (closest to the archer) of bar 14 by nuts 11A and 11B. The left end of bolt 11 has a pair of horizontal, transverse holes 8 therein. The legs of a U-shaped member formed by rods 16 extend through holes 8. A set screw 17 is threaded tightly into a threaded hole the left end of bolt 11 to look the nearest one of rods 16 into place.

Arrow rest 12 is connected by hinge 13 to the rear end portions of rods 16. Arrow rest 12 includes a generally V-shaped strip of metal (or other suitable material) including a lower arm 12A and an upper arm 12B having bifurcated end sections 12C and 12D. Hinge 13 includes a pin that extends through holes in rods 16 and through a channel formed by the outer end of arm 12A. Arrow rest 12 can be composed of a strip of stainless steel approximately one-fourth of an inch wide and 0.025 inches thick. A small return spring 15 is anchored to one of rods 16 and the pivot pin of hinge 13 and engages the upper surface of arm 12A of arrow rest 12.

Figure 2:
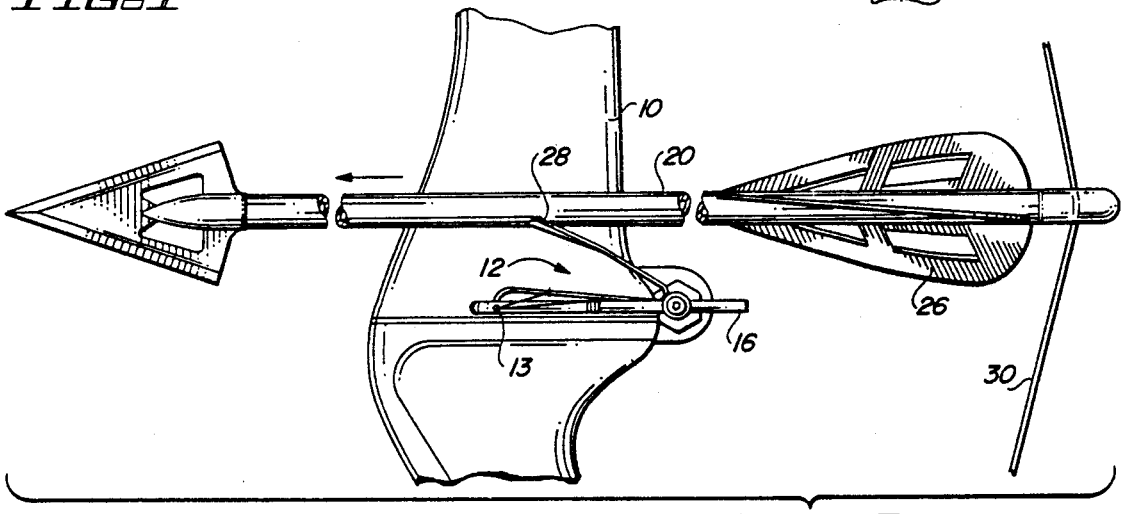
FIG. 2 is a diagram showing the arrow rest of FIG. 1 attached to a bow illustrating pivoting due to striking of the arrow rest arms by fletching of an arrow.

FIG. 2 shows arrow 20, the shaft of which is supported by the upper portion of arrow rest 12 at contact points 28 of arm end sections 12C and 12D. The noch of arrow 20 engages a drawn bowstring 30. Arrow 20 has spiral fletching vanes 26 on its rear end. The purpose of spiral fletching vanes 26 is to produce rotation of arrow 20 which stabilizes it during flight.

Figure 5:
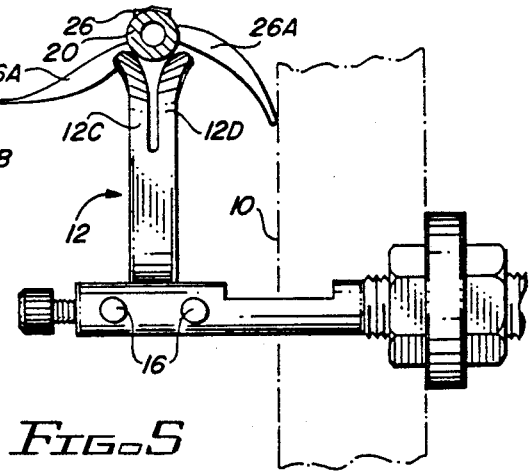
FIG. 5 is a rear elevation view of the arrow rest shown in FIG. 1.

As explained previously, an unsolved problem of the archery art is that the lower spiral fletching vanes of a released arrow usually strike the arrow rest as they pass by, despite the presence of a slot in the arrow rest to accommodate the lower spiral fletching vanes as it passes by. FIG. 5 shows how the spiral vanes 26A can strike the tops of arm sections 12C and 12D. The resulting upward counter-force on the tail end of the arrow as it leaves the bow produces instability and vertical plane flexing of the arrow that reduces accuracy and distance of the shot.

In accordance with the present invention, hinge 13 in FIG. 1 pivotally connects arrow rest 12 to its support, whereas in the closest prior art, the connection of arrow rest 12 to its support is rigid, rather than hinged.

Figure 3:
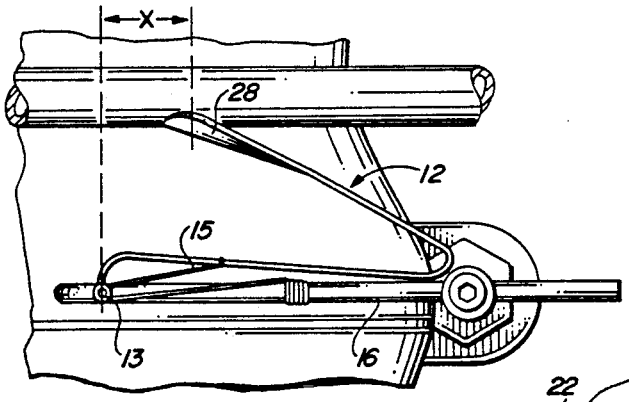
FIG. 3 is an enlarged view of a portion of FIG. 2.
Figure 4:
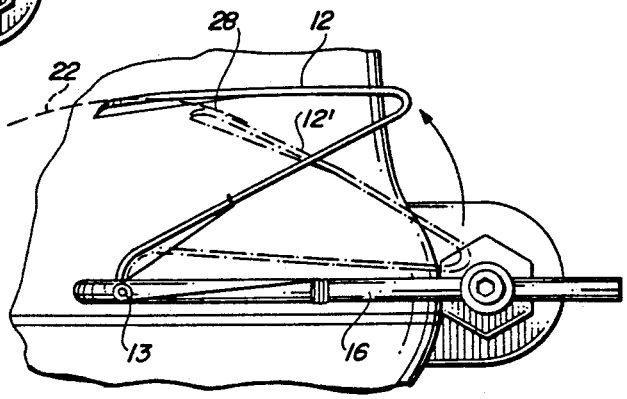
FIG. 4 is a view illustrating pivoting of the arrow rest in FIG. 3.
Figure 11:
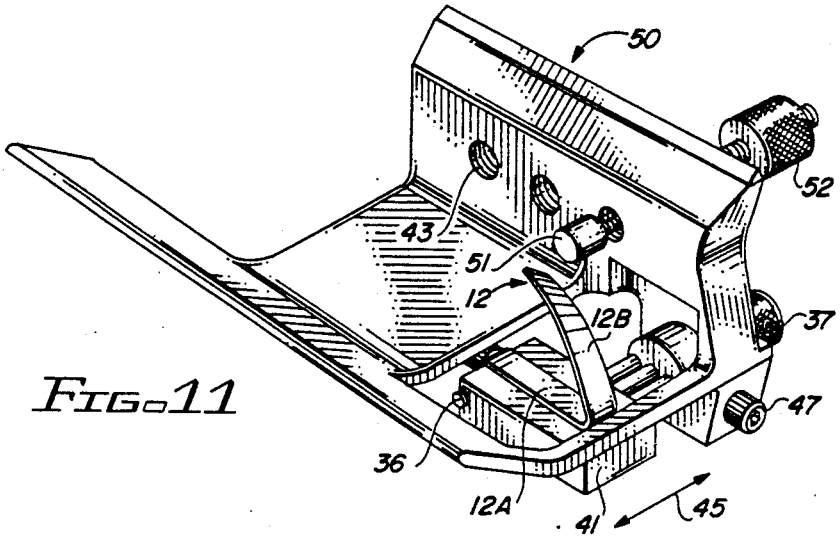
FIG. 11 is a perspective view of another embodiment of the invention.
Figure 12:
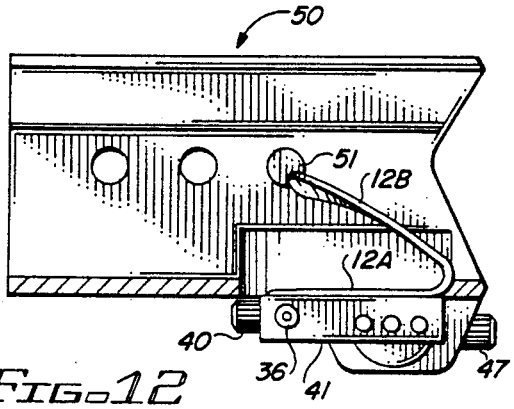
FIG. 12 is a partial section view of the embodiment of FIG. 11.

In the embodiment of FIG. 1, when the lower spiral fletching vanes 26 strike arrow rest 12, it pivots forward from its initial position 12' along arc 22, as shown in FIG. 4, arc 22 being centered at hinge point 13. Contact point 28' on which the shaft of arrow 20 (as shown in FIG. 2) is supported by arms 12C and 12D, is located slightly behind the pivot point of hinge 13. In embodiments of the invention constructed to date, contact points 28 are located as little as one-sixteenth of an inch behind the pivot point of hinge 13, as indicated by the distance X in FIG. 3. It is important that the distance X shown in FIG. 3 not be too great, so that the support points 28 do not rise much as the spiral fletching vanes 26 strike the arrow rest and pivot it forward as shown in FIG. 4. This prevents arrow rest 12 from producing much upward force on the tail end of arrow 20 as it leaves the bow, and almost eliminates the above mentioned vertical plane flexing of the arrow shaft during flight.

The arrow rest 12 of FIG. 1, used with a broadhead hunting arrow having spiral fletching as shown in FIG. 2, enables an expert archer to shoot with enough accuracy to keep such arrows within a six inch grouping at a target distance of approximately 60 yards. This result shows that the erratic flight caused by spiral fletching striking prior arrow rests has been greatly reduced from the above-mentioned thirty inch grouping, which is the best achievable without the hinged arrow rest of the present invention.

FIGS. 6–10 show another embodiment of the invention, in which an arrow rest 12 essentially identical to the one shown in FIG. 1 is mounted on a support 35. Support 35 is bolted through an opening 42 to a suitable compound bow handle. The embodiment of FIGS. 6–10 provides sideways adjustability of a support block 41 on which arrow rest 12 is mounted, as best shown in FIG. 8. A micrometer control 37 is turned to effectuate sideways adjustment of support block 41 in the direction of arrows 45. Block 41 slides on a pair of rods 39 in response to turning of micrometer handle 37. A pair of cone-tip set screws 36 extend through the vertical side walls of block 41 to engage mating cone-shaped recesses in bushing 44, to which the end of lower member 12A is attached by screw 40. The tightness of cone-tip screws 36 can be adjusted to produce a desired amount of friction to resist forward pivoting of arrow rest 12.

In the embodiment of FIGS. 6–10, arrow rest 12 pivots forward from its initial position to the position indicated by dotted lines 12' when spiral fletching vanes 26 of arrow 20 strike arms 12C,D. As in the embodiment of FIG. 1, the contact point 28 (at which the arms 12C,D support the shaft of arrow 20 prior to release) travels along arc 22, rising very little, and preventing much upward counter-force from being produced on the tail end of the arrow. This nearly eliminates erratic flight of the arrow due to vertical plane flexing during flight.

FIGS. 11–14 show another embodiment of the invention wherein a support 50 is bolted through aperture 43 to the left hand face of the handle of a suitable compound bow. A spring-loaded button-type arrow rest 51 having a micrometer control 52 is mounted in the side vertical wall of support 50. The sideways extension of spring-loaded button 51 is adjusted by micrometer control 52. The arrow rest 12 of FIG. 11 includes a single member 12A, 12B including a lower member 12A that is pivotally attached by cone-tipped set screws 36 to laterally moveable mounting block 41, similarly to the embodiment of FIGS. 6–10. As in FIGS. 6–10, micrometer control 37 adjusts the lateral position of mounting block 41 in the direction of arrows 45. Set screw 47 locks the micrometer assembly 37 into an opening in support 50.

Figure 14:
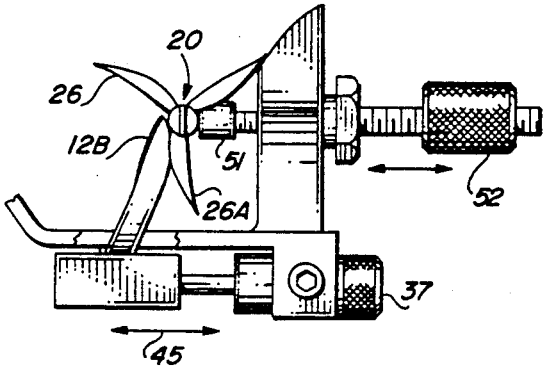
FIG. 14 is a partial rear elevational view of the embodiment of FIG. 11.
Figure 13:
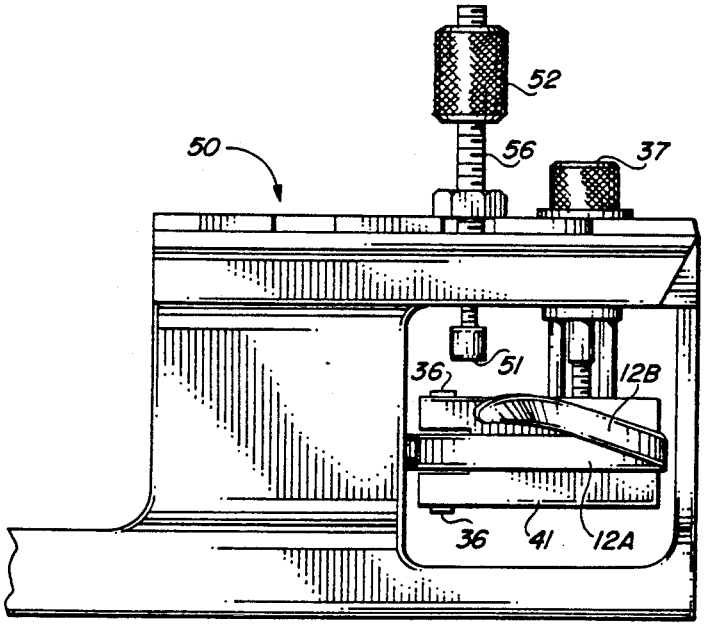
FIG. 13 is a partial top view of the embodiment of FIG. 11.

In the embodiment of FIGS. 11–14, one spiral fletching vane 6A extends downward through a gap between the outer end of button 51 and the upper end of arrow rest arm 12B, as shown in FIG. 14. As before, arrow rest member 12A,12B pivots forward when that spiral fletching vane strikes arrow rest arm 12B, preventing a large upward counter-force from being applied to the tail end of the arrow as it passes by. Spring-loaded button 51 also yields to any sideways movement of the arrow shaft as it passes by. This embodiment of the invention greatly reduces both vertical plane flexing and horizontal plane flexing from being imparted to the arrow as it is released.

Figure 15:
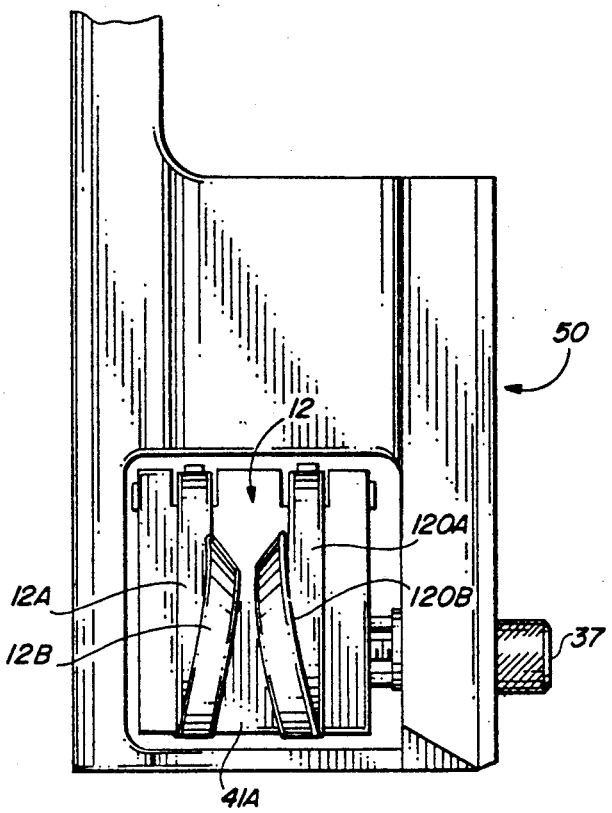
FIG. 15 is a partial top view of an alternate embodiment of the invention with two independently pivotal arrow rest arms.
Figure 16:
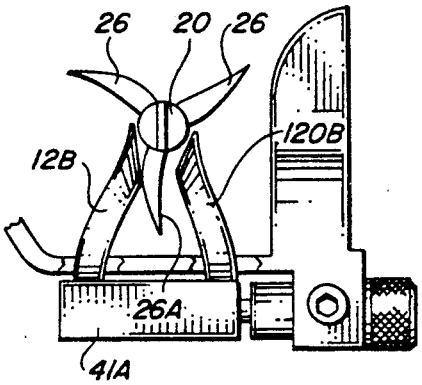
FIG. 16 is a partial rear elevational view of the embodiment of FIG. 15.

FIGS. 15 and 16 show another embodiment similar to that of FIGS. 11–14, except that two independently pivotable arrow rest arms 12A,12B and 120A,120B are included within arrow rest mechanism 12. Both arms 12A,12B and 120A,120B are pivotally connected to block 41 in precisely the same manner that arm 12A,12B is connected in the embodiment of FIGS. 11–14. Then, if only one spiral fletching vane, such as 26A in FIG. 16, strikes one of the pivotal arm sections such as 12B, only that arm 12A,12B pivots forward. This imparts less drag on the released arrow 20, producing less vertical plane flexing of the arrow than if both arms 12B and 120B are rigidly connected together. This improves the accuracy and repeatability of the shots.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. An arrow rest mechanism for attachment to a bow, comprising in combination:

(a) a support rigidly attached to the bow;

(b) an arrow rest assembly including i. at least one member having an arrow shaft contact point supporting a shaft of a released arrow, ii. a hinge positioned in fixed relationship to the support and pivotally connecting the member to the support, a pivot axis of the member being located a predetermined distance ahead of the contact point, the member pivoting forward in reaction to being struck by fletching of the released arrow and imparting minimal upward displacement of the contact point, whereby vertical plane flexing and erratic flight of the arrow due to striking of the member by the fletching is nearly eliminated.

2. The arrow rest mechanism of claim 1 wherein the predetermined distance is at least approximately one-sixteenth of an inch.

3. The arrow rest mechanism of claim 1 wherein the member is resilient and imparts an upward force to the shaft of the released arrow in reaction to spine of the released arrow.

4. The arrow rest mechanism of claim 3 wherein the fletching is spiral fletching.

5. The arrow rest mechanism of claim 1 wherein the member includes first and second resilient arms each supporting the shaft of the released arrow and absorbing the vertical forces due to the vertical bending of the released arrow.

6. The arrow rest mechanism of claim 5 wherein the first and second arms are bifurcated end sections of a single arm.

7. The arrow rest mechanism of claim 1 including two members each having a separate arrow shaft contact point supporting the shaft, each member being independently pivotally connected to the support.

8. The arrow rest mechanism of claim 1 wherein the arrow rest assembly includes a single resilient arm supporting a lower surface of the shaft of the arrow, and further includes a resilient button assembly engaging a side of the released arrow and absorbing horizontal forces due to horizontal plane flexing of the arrow.

9. The arrow rest mechanism of claim 1 wherein the member is generally V-shaped, a first leg of the member having a free end pivotally connected to the bracket, the contact point being on a free end portion of a second leg.

10. The arrow rest mechanism of claim 1 further including spring means for urging the member toward an initial position.

11. The arrow rest mechanism of claim 1 including a moveable block to which the hinge is connected, and means for precisely moving the block relative to the bracket to position the arm in a distance perpendicular to a direction of the arrow.

12. The arrow rest mechanism of claim 1 wherein the hinge includes a pair of cone-shaped set screws engaging recesses in ends of a rotatable support to which the member is attached, to adjust resistance of the member to pivoting.

13. A method for reducing vertical plane flexing of a released arrow due to striking of an arrow rest member by a fletching vane of the arrow as it passes by the member, the method comprising the steps of:

(a) pivotally connecting the member in fixed relation to a handle of the bow, by means of a pivotal connection spaced ahead of a contact point of the member, the contact point supporting the arrow prior to release;

(b) releasing the arrow, the vane striking the member as it passes by; and (c) pivoting the member in the direction of travel of the arrow in response to the striking to reduce a counter-force produced on a tail end of the arrow by the striking and thereby reducing the vertical plane flexing of the arrow which otherwise would occur during flight.

* * * * *